United States Patent [19]

McInerny

[11] 4,436,224

[45] Mar. 13, 1984

[54] DISPENSER FOR FLUIDS AND PAPER TOWELS

[76] Inventor: John McInerny, 25 Central Sq., Grafton, Mass. 01519

[21] Appl. No.: 351,189

[22] Filed: Feb. 22, 1982

[51] Int. Cl.[3] ..... B67D 5/06; B65H 19/00

[52] U.S. Cl. ..... 222/183; 222/192; 222/321; 222/181; 221/96; 242/55.55; 239/52

[58] Field of Search ..... 242/55.54, 55.55; 239/51, 59, 289; 206/409; 221/96, 135, 34, 45, 63, 282, 283; 222/192, 173, 321, 143, 183, 180, 181

[56] References Cited

U.S. PATENT DOCUMENTS

| | | | |
|---|---|---|---|
| 649,062 | 5/1900 | Levett | 242/55.55 |
| 1,426,021 | 8/1922 | Svendsgaard | 221/96 |
| 2,411,310 | 11/1946 | Wilkins | 221/34 |
| 2,789,725 | 4/1957 | Carpet | 221/96 |
| 2,806,738 | 9/1957 | Tsakalas | 239/59 |
| 3,151,822 | 10/1964 | Glaner | 242/55.55 |
| 3,192,008 | 6/1965 | Dwyer | 21/77 |
| 3,329,367 | 7/1967 | Paradiso | 242/55.55 |
| 3,557,946 | 1/1971 | Sviokla | 206/47 |
| 3,848,803 | 11/1974 | Levey | 239/59 |
| 4,030,676 | 6/1977 | Bardsley | 242/55.54 |

*Primary Examiner*—H. Grant Skaggs
*Attorney, Agent, or Firm*—Blodgett & Blodgett

[57] ABSTRACT

Dispenser for fluid and rolled paper towels comprising a fluid container having an outlet aperture, a base portion with an upper horizontal surface, and an elongated portion which extends vertically from the base portion and is adapted to extend through the bore of a roll of paper towels, so that the roll is supported on the horizontal surface and the top of the neck portion extends above the roll. The dispenser also includes a fluid dispensing fixture operatively connected to the outlet aperture.

14 Claims, 7 Drawing Figures

DISPENSER FOR FLUIDS AND PAPER TOWELS

BACKGROUND OF THE INVENTION

This invention is generally directed to a dispenser for fluids which are used for cleaning and personal care, such as liquid soap, skin moisteners, air fresheners, and for paper towels in roll form.

Papers towels in roll form and liquid soap are used extensively in homes and in industry. There are many types of dispensers for both paper towels and liquid soap as well as other personal care fluids. The rolls of paper towels are wrapped around a cylindrical cardboard tube so that the roll has a central bore. This enables the roll to be mounted on any one of a variety of towel dispensers. One type of towel dispenser includes a spindle which is removably mounted in brackets; the spindle is removed from the brackets and extended through the bore of the paper roll. Then, the spindle carrying the roll is remounted on the brackets. Another type of dispenser includes a pair of spring-loaded brackets which are provided with inwardly-directed fingers. The brackets are forced apart to an open position and the paper towel roll is placed between the fingers. Release of the brackets enables the fingers to enter the bore from the opposite ends to support the roll.

Fluid dispensers are in the form of bottle-like containers which are provided with a dispensing fixture in the form of a mechanical pump cap or spigot.

The fluid and towel dispensers are adapted to be mounted on either a vertical supporting structure, such as a wall or cabinet, or supported on a horizontal surface, such as a sink, counter, or shelf.

In many cases, the addition of two more dispensers such as a soap dispenser and a towel dispenser to an already crowded sink or lavatory area creates a space problem, particularly in small bathrooms. In the case of multiple dispensers, there may not be enough available wall space due to the presence of other fixtures such as towel racks, mirrors, cup dispensers, etc. In the case of dispensers which are supported on a horizontal surface, most of the available horizontal-supporting surfaces may be occupied by other personal care items. In addition to the problem of storage space, the unmounted dispensers are apt to be moved around and misplaced. These and other difficulties with the prior art devices have been obviated by the present invention.

It is, therefore, an outstanding object of the invention to provide a single dispenser for both fluid and paper towels.

Another object of this invention is the revision of a dispenser which includes a container for internally holding fluid and externally supporting a roll of paper towels.

A further object of the present invention is the provision of a dispenser which includes a case for enclosing the liquid and roll supporting elements of the dispenser and which includes means for withdrawing towels from the roll and which provides a tear edge for the paper towels.

It is another object of the instant invention to provide a dispenser for dispensing liquid and vapor.

A still further object of the invention is the provision of a dispenser for fluid and paper towels in which the fluid dispensing and towel dispensing elements of the dispenser are always together so that a minimum of supporting space is used and the paper towels always remain with the fluid container.

It is a further object of the invention to provide a dispenser for fluid and paper towels, which dispenser is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a dispenser for both a fluid and a roll of paper towels. The dispenser comprises a fluid container having an outlet aperture, a broad base portion and a narrow neck portion extending upwardly from the base portion and which fits into the central bore of a roll of paper towels so that the roll is supported on the base portion. A fluid dispensing fixture is connected to the outlet aperture.

More specifically, the dispenser includes a hollow case having an open top for receiving the fluid container and roll of paper towels. The case has a continuous vertical wall which is provided with an opening through which paper towels are withdrawn from the roll.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
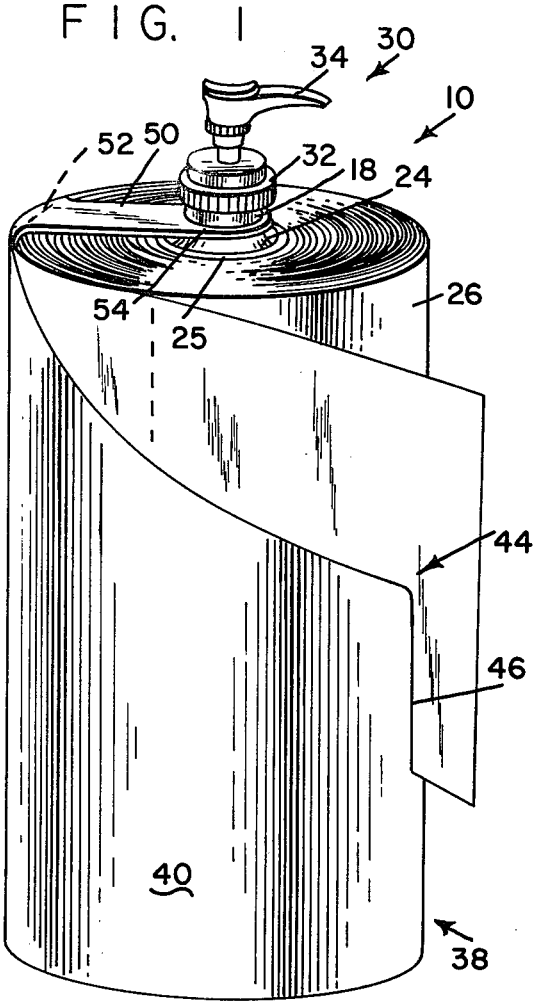
FIG. 1 is a perspective view of a dispenser embodying the principles of the present invention.

Referring to FIGS. 1–4, a dispenser embodying the principles of the present invention is generally indicated by the references numeral 10 which includes a hollow bottle-like fluid container generally indicated by the reference numeral 12. The container 12 comprises a broad base portion 14 and an elongated neck portion 16, which extends upwardly from the center of the base portion 14 and terminates in a reduced threaded top portion 18. The base portion 14 has a round bottom wall 19, an annular vertical side wall 14, and a top wall which forms a flat horizontal surface 21. Neck portion 16 is in the form of a cylindrical tube which extends upwardly from the flat horizontal surface 21. The interior space within the neck portion 16 and the base portion 14 form a collective chamber 22 for holding a fluid to be dispensed.

Figure 3:
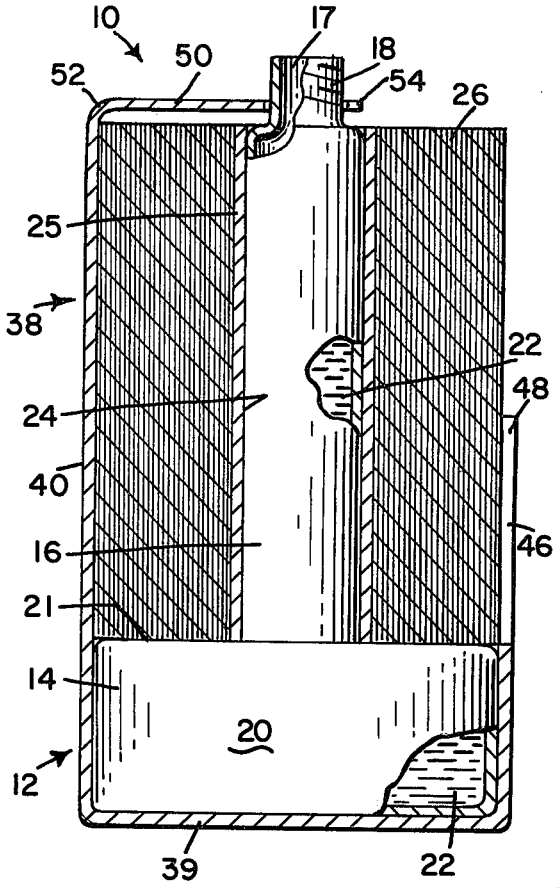
FIG. 3 is a vertical sectional view of the dispenser taken on the line III—III of FIG. 2.

The paper towels to be dispensed are in the form of a roll 26 which is formed by a plurality of towels wrapped around a cylindrical tubular core 25 which has a central bore 24. The neck portion 16 is adapted to fit into the bore 24 of the roll so that the roll rests on the horizontal surface 21 and the top portion 18 extends above the roll as shown in FIG. 3.

Figure 4:
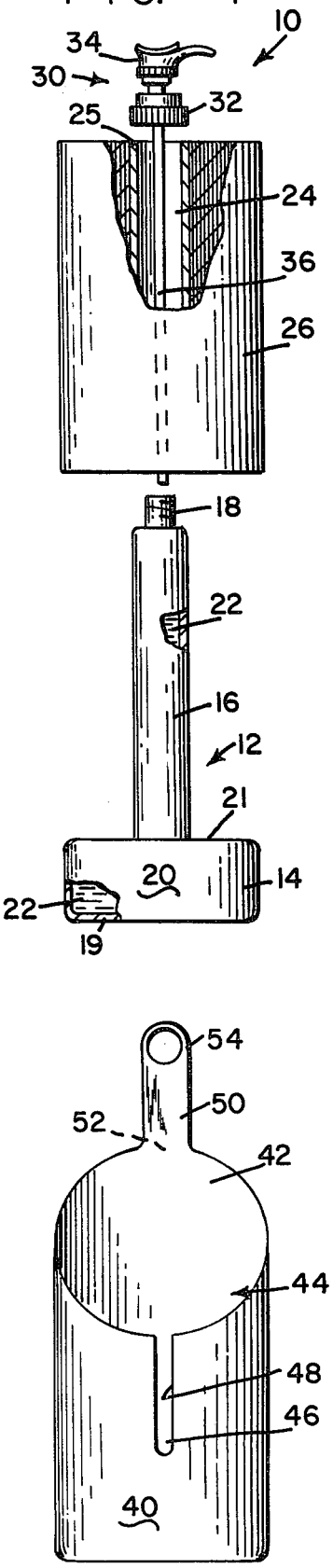
FIG. 4 is an exploded view of the dispenser.

The top portion 18 is adapted to receive a fluid dispensing fixture generally indicated by the reference numeral 30. The dispenser 30 is illustrated in FIGS. 1 and 4 is of the mechanical pump-type commonly used in liquid dispensers. The dispenser 30 includes a threaded cap 32 which is adapted to screw onto the top portion 18, a spout 34 extending from the cap 32, and an elongated tube 36 operatively connected to the spout 34 and extending downwardly from the cap 32. When the fluid dispensing fixture 30 is applied to the top portion 18 as shown in FIG. 1, the tube 36 extends down through the neck portion 16 and into the base portion 14. Fluid within the chamber 22 is pumped up through the tube 36 by depressing the spout 34 which moves relative to the cap 32 and is dispensed through the end of the spout.

Figure 2:
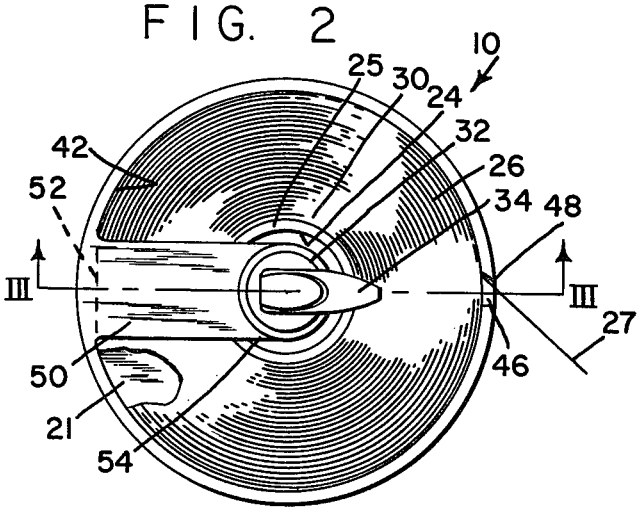
FIG. 2 is a plan view of the dispenser.

Dispenser 10 also includes a hollow case, generally indicated by the reference numeral 38, which comprises a round bottom wall 39, and an annular vertical wall 40 which extends upwardly from the bottom wall 39 to a top opening 42. The vertical wall 40 also has a side opening generally indicated by the reference numeral 44 which includes a narrow vertical slot 46 which extends upwardly from a point adjacent the horizontal surface 21. The side opening flares outwardly and upwardly from the top of the narrow vertical slot 46 so that it merges with the top opening. One side of the slot 46 is provided with a tear edge 48. The towels are in a continuous strip and divided along perforated seam lines. The upper portion of the side opening 42 allows the end of the leading towel 27 to be grasped by the fingers and pulled through the slot 46 until the seam line 28 is aligned with the tear edge 48. The leading towel 27 is then separated from the roll 26 along the seam line 28 by pulling the leading paper towel 27 laterally against the tear edge 48. A retaining flap 50 is hingedly connected at 52 through the top of the vertical wall 40 at a point which is generally diametrically opposed to the vertical slot 46. The case 38 is preferably made of a generally flexible material such as leather or plastic which enables the flap 50 to bend from a normal vertical position as shown in FIG. 4 to a generally horizontal position as shown in FIGS. 1–3. The free end of the flap 50 is provided with a round loop 54 which is adapted to fit over the top portion 18 as shown in FIGS. 1 and 3.

The operation and advantages of the preferred embodiment will now be readily understood in view of the above description. The chamber 22 of the fluid container 12 is filled with the fluid to be dispensed such as, for example, liquid soap by pouring the liquid into the aperture 17. The neck portion 16 of the container is inserted into the bore 24 of the paper towel roll 26 so that the bottom of the roll rests on the horizontal surface 21. The fluid container 12 and the paper roll 26 are then inserted as a unit into the case 38 through the top opening 42. The flap 50 is then bent on the hinge line 52 so that the loop 54 fits over the top portion 18 as shown in FIG. 3. The elongated tube 36 of the fluid dispensing fixture 30 is then inserted into the fluid container 12 through the outlet aperture 17 so that it extends down into base portion 14. Finally, the cap 32 is screwed onto the top portion 18 as shown in FIG. 1. The dispenser 10 is now ready for use and can be placed in any available supporting surface occupying an amount of space equal to the area of the bottom wall 39. If desired, the case 38 can be provided laterally extending flanges to enable the dispenser to be mounted on a wall. In addition, the dispenser 10 always insures that the liquid soap and paper towels will remain in the same location. The flared top portion of the side opening 44 enables the free end of the leading paper towel 27 to be easily grasped, even if the leading end is located within the confines of the case 38. Although it is anticipated that the dispenser will be commonly used for dispensin liquid soap, it is also contemplated that the dispenser can be used for dispensing other liquids as well, such as hand lotion or liquid detergent.

FIRST MODIFICATION

Figure 5:
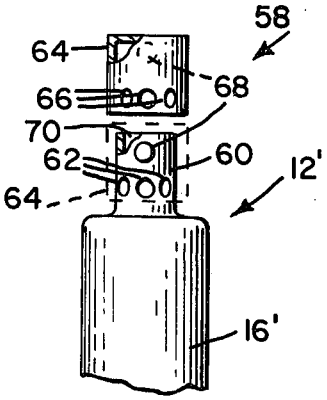
FIG. 5 is a fragmentary view of a first modification.

Referring to FIG. 5, a first modification is generally indicated by reference numeral 58 and involves changes only in the upper portion of the fluid container which is generally indicated by the reference numeral 12'. The neck portion 16' of the container 12' terminates in a top portion 60 which has a plurality of holes 62. A cap 64 has a matching set of holes 66 which are aligned with holes 62 when the cap is placed over the top portion 60. This is known as the open position of the dispenser. By rotating the cap 64 on the top portion 60 so that the holes 66 are no longer aligned with the holes 62, the top portion 60 is effectively sealed. This is referred to as the closed position. The fluid container 12' is filled with an aromatic substance commonly used in air fresheners which vaporizes into the atmosphere. When the cap is in the closed position, the holes 66 and 62 are misaligned, and vapors are prevented from escaping from the top portion 60. When the cap 64 is rotated to the open position so that the holes 66 are aligned with the holes 62, the vapors are allowed to escape from the container 12'. The top portion 60 and the cap 64 are also provided with cooperating detent means 68 which enables the cap 64 to stay in the open position. Similar detent means may also be used to maintain the cap in the closed position if desired. The upper end of the top portion 60 also provided with a fill open 70 which enables the fluid container 12' to be replenished.

SECOND MODIFICATION

Figure 6:
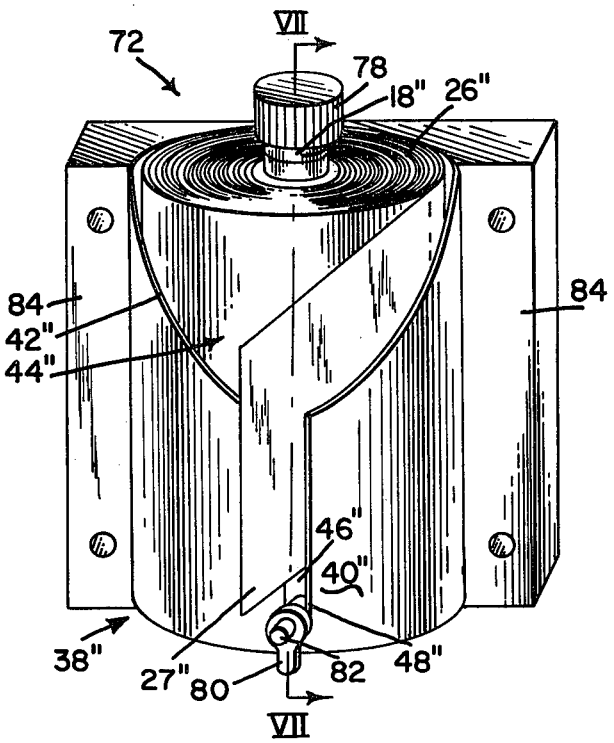
FIG. 6 is a perspective view of a second modification.
Figure 7:
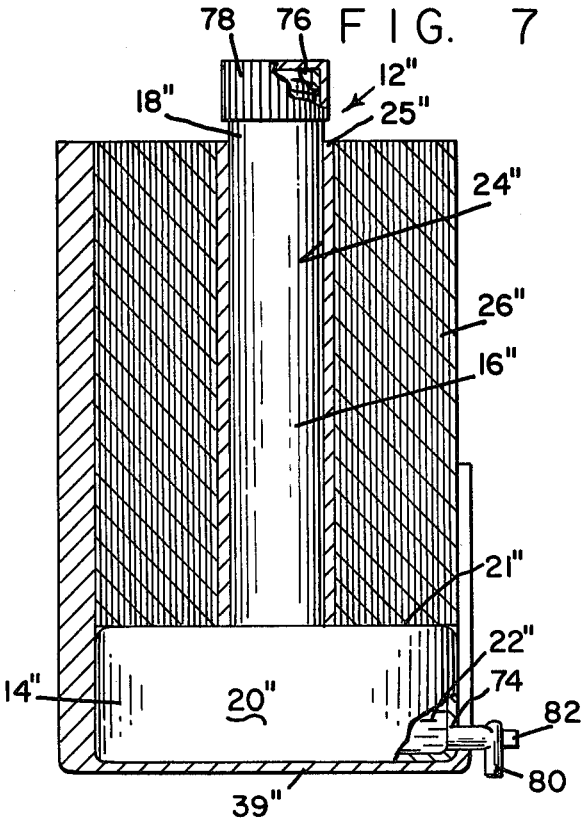
FIG. 7 is a vertical-sectional view taken on line VII—VII of FIG. 6.

Referring to FIGS. 6 and 7, a second modified dispenser is generally indicated by the reference numeral 72 and includes a fluid container 12'' which is similar to the fluid container 12 in that it comprises a broad base portion 14'' and an elongated narrow neck portion 16''. However, the base portion 14'' has a vertical wall 20'', which is provided with an outlet aperture 74. The upper end of the neck portion 16'' is provided with a threaded top portion 18'', which has a fill opening 76. Fill opening 76 is closed by means of a cap 78 which is adapted to be threaded onto the top portion 18 as shown in FIG. 7. A spigot 80 is operatively connected to the outlet aperture 74 and includes a push-button 82 which enables liquid in the interior chamber 22' be dispensed through the spout of the spigot. The neck portion 16'' is adapted to extend through the bore 24'' of a paper towel 26'' so that it is supported on the horizontal surface 21'' of the base portion 14''.

Second modification 72' also includes a case 38'' which is similar to case 38 in that it includes an annular vertical wall 40'' having a top opening 44'' and a side opening 44'' which includes a narrow vertical slot 46''. However, the slot 46'' extends down to a bottom wall 39'' of the case. This allows the spigot 80 to extend beyond the case 38 as shown in FIGS. 6 and 7. The case 38'' is provided with flanges 84 which enable the case to be mounted on a vertical supporting structure such as a wall or cabinet. It's preferred that the dispenser 72 be mounted on a wall since the spigot 80 located near the bottom of the dispenser, however, dispenser may be supported on a flat horizontal surface, provided that the spigot 80 extends over the edge of that surface.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Dispenser for fluid and paper towels in which the towels are arranged in a roll having a central bore, the dispenser comprising:

(a) a fluid container comprising:

1. a base portion with an upper horizontal surface,
2. an elongated neck portion which extends vertically from the base portion and is adapted to extend through the bore of a roll of paper towels, so that the roll is supported on said horizontal surface and the top of said elongated neck portion extends above the roll, and
3. an outlet aperture at the top of the elongated neck portion;

(b) a fluid dispensing fixture consisting of a manually operated pump comprising:

1. a cap adapted to fit on top of the elongated neck portion,
2. a spout on top of the cap, and
3. an elongated tube which is operatively connected to the spout and which extends down into the base portion of the container.

2. Dispenser as recited in claim 1, wherein said dispenser includes a hollow case having a top opening for receiving the fluid container and roll of paper towels, said case having a continuous vertical wall which is provided with a side opening through which paper towels can be withdrawn from the roll.

3. Dispenser as recited in claim 2, wherein said side opening is a narrow vertical slot which extends upwardly from the upper surface of the base portion, one side of said slot forming a tear edge for said paper towels.

4. Dispenser as recited in claim 3, wherein an upper portion of the side opening flares outwardly from the top of the slot, so that it merges with the top opening.

5. Dispenser as recited in claim 2, wherein the base has a cylindrical vertical wall and the vertical wall of the case is cylindrical.

6. Dispenser as recited in claim 2, wherein a retaining flap is hingedly attached to the top of the vertical wall at a point which is opposite said vertical slot, said flap having a free end which is provided with a loop which fits around said neck portion, when the fluid container is located within the case.

7. Dispenser for fluid and paper towels in which the towels are arranged in a roll having a central bore, the dispenser comprising:

(a) a fluid container having an outlet aperture and comprising:

1. a base portion with an upper horizontal surface,
2. an elongated neck portion which extends vertically from the base portion and is adapted to extend through the bore of a roll of paper towels, so that the roll is supported on said horizontal surface and the top of said elongated neck portion extends above the roll, and
3. an outlet aperture at said base portion, (b) a fluid dispensing fixture consisting of a spigot at said outlet aperture.

8. Dispenser as recited in claim 7, wherein the elongated neck portion has a top portion which is provided with a fill aperture and which is adapted to receive a fill cap.

9. Dispenser as recited in claim 7, wherein said dispenser includes a hollow case having a top opening for receiving the fluid container and roll of paper towels, said case having a continuous vertical wall which is provided with a side opening through which paper towels can be withdrawn from the roll.

10. Dispenser as recited in claim 9, wherein said side opening is a narrow vertical slot which extends upwardly from the upper surface of the base portion, one side of said slot forming a tear edge for said paper towels.

11. Dispenser as recited in claim 10, wherein an upper portion of the side opening flares outwardly from the top of the slot, so that it merges with the top opening.

12. Dispenser as recited in claim 9, wherein the base has a cylindrical vertical wall and the vertical wall of the case is cylindrical.

13. Dispenser as recited in claim 9, wherein the base portion has an annular vertical wall which is provided with the outlet aperture and wherein said side opening is a narrow vertical slot, one side of the slot forming a tear edge for said paper towels, said spigot extending through the slot to a point outside of the case.

14. Dispenser as recited in claim 13, wherein the case has a vertical flange which enables the case to be fastened to a supporting structure.

* * * * *